United States Patent [19]

Guenther et al.

[11] 4,027,616

[45] June 7, 1977

[54] PROTECTION MEANS FOR DEPTH CONTROL DEVICE

[75] Inventors: Robert O. Guenther, Irving; Donald F. Huffhines, Richardson; James W. Krall, Irving; Charles D. Ray, Dallas, all of Tex.

[73] Assignee: Mobil Oil Corporation, New York, N.Y.

[22] Filed: Dec. 10, 1975

[21] Appl. No.: 639,534

[52] U.S. Cl. ..... 114/244

[51] Int. Cl.[2] ..... B63B 21/00

[58] Field of Search ..... 114/235 R, 235 B; 340/7 R, 7 PC

[56] References Cited

UNITED STATES PATENTS

| | | | |
|---|---|---|---|
| 3,375,800 | 4/1968 | Cole et al. | 114/235 B |
| 3,434,446 | 3/1969 | Cole | 114/235 B |
| 3,613,629 | 10/1971 | Rhyne et al. | 114/235 B |
| 3,672,322 | 6/1972 | Van Der Linde | 114/235 B |
| 3,774,570 | 11/1973 | Pearson | 114/235 B |
| 3,896,756 | 7/1975 | Pearson et al. | 114/235 B |

*Primary Examiner*—Trygve M. Blix

*Assistant Examiner*—Stuart M. Goldstein

*Attorney, Agent, or Firm*—C. A. Huggett; Drude Faulconer

[57] ABSTRACT

A structure is provided for protecting a depth control device used on a marine seismic cable where the device is of the type having a hull formed in two parts and a pair of wings pivotably mounted thereon. The protective structure is comprised of a pair of framelike structures and a ring structure. A framelike structure is mounted on the hull just forward of each wing and extends outward at an angle greater than the angle formed by the leading edge of the wing. This provides an unbroken path from the hull to the wing along which an obstacle, e.g., buoy line, can slide over the control device without becoming lodged in the gap normally existing between the wing and the hull. The ring structure is positioned on the seismic cable just forward of the control device to protect the device against a buoy line or the like becoming lodged in the gap which is inherently present when the two parts of the hull are joined about a seismic cable. Not only does the present invention protect the depth control device, but it also prevents damage to the buoy lines.

8 Claims, 9 Drawing Figures

FIG. 5
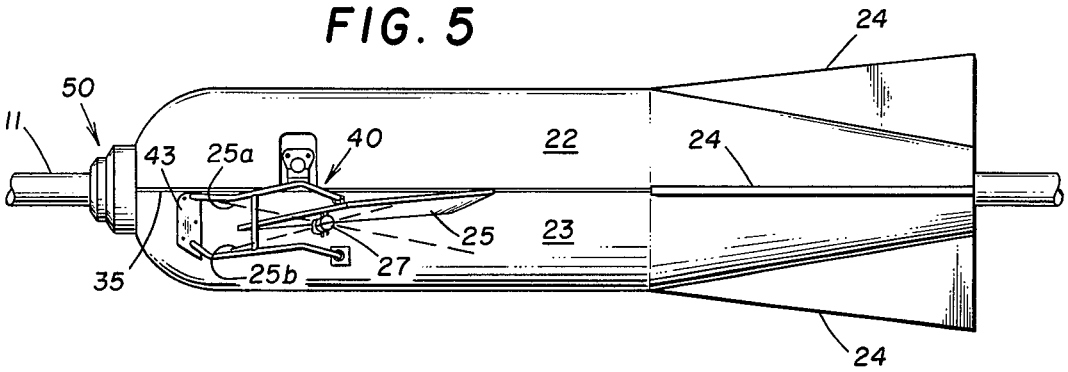
FIG. 6
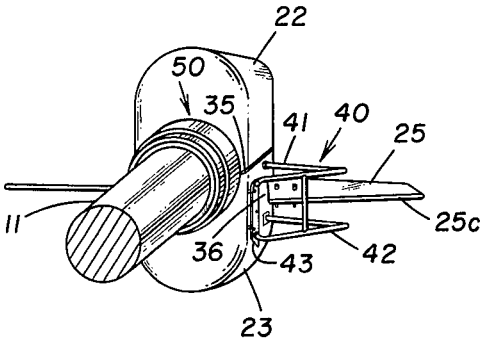
FIG. 7
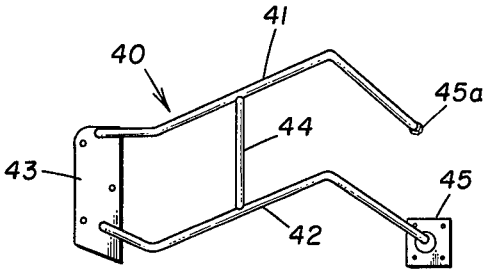
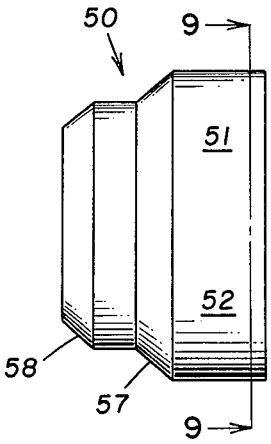
FIG. 8
FIG. 9
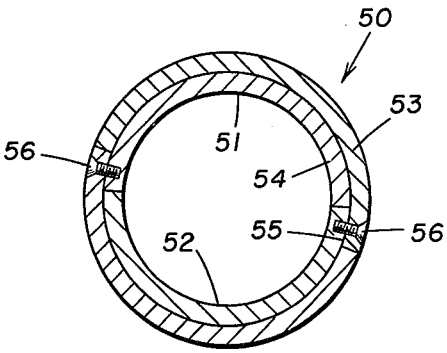

PROTECTION MEANS FOR DEPTH CONTROL DEVICE

BACKGROUND OF THE INVENTION

The present invention relates to a marine seismic cable system and more particularly relates to a means for (1) protecting the depth control devices which are used to maintain a seismic cable at a desired depth during a seismic survey operation, and (2) protecting buoy or anchor lines in an area being surveyed from being damaged by the depth control devices.

In a typical marine seismic operation, an electronically equipped vessel tows both a seismic source and a seismic cable or streamer through an area to be explored. The source is actuated to generate signals which in turn reflect off various strata underlying the marine bottom. These reflected signals are received by each of a plurality of geophones or the like which are spaced along the length of the cable. The received signals are recorded and processed to produce the desired seismic record. Due to the criticality of all measurements involved, it is important that the cable be towed and maintained at a predetermined, known depth during the operation.

One of the most successful techniques for maintaining the cable at a desired depth during a seismic operation involves the use of depth control devices of the type commonly referred to as hydroplanes, paravanes, or simply as "birds". Such devices are attached at spaced points along the cable and are well known in the art, e.g., see U.S. Pat. Nos. 3,375,800; 3,434,446; 3,774,570; and 3,896,756. A basic depth controller of this type has a torpedo-shaped hull made of plastic material which is made in two parts and hinged together to facilitate assembly directly onto the cable. At least one set of adjustable wing members is pivotably mounted near the forward portion of the hull and is controllable (preferably by remote control electronics carried in the hull) so that the wings may be moved up or down to cause the cable to rise or sink as desired.

Unfortunately, due to its design a depth controller of this type is susceptible to damage when certain obstacles are encountered in a survey area. One such obstacle is the lines or mooring cables which connect a lobster or crab trap to its marker buoy on the surface. If a seismic cable is towed through an area where such traps are set, a buoy line may contact and ride along the seismic cable until it engages a depth controller or "bird" on the cable. The buoy line which is normally a length of high strength nylon cord or the like may lodge either (1) within the slot formed by the mating halves of the hull of the bird, or (2) in the space between the wing of the bird and the hull. In either event, continued towing of the cable causes the buoy line to develop a "sawing" effect which can seriously damage the expensive bird and thereby causes a substantial delay in the seismic operation. The bird can also damage the line which connects the lobster or crab trap to its marker buoy.

As will be more fully discussed below, attempts have been made to avoid part of these problems by providing shield means on the hull just forward of the wings but this remedy has only met with partial success. Since the ability of wings to move must be maintained for a bird to function as intended, the shield means cannot come into contact with the wings and therefore a space still exists between the shield means and a wing in which a buoy line or the like can find its way.

SUMMARY OF THE INVENTION

The present invention provides a means for protecting a depth controller or bird from certain obstacles sometimes encountered during a marine seismic operation.

Structurally, the means comprises a framelike structure which is affixed on each side of the hull of a bird-type, depth controller and positioned to partially enclose the leading edge of the respective, adjustable wing on that side of the hull. The protective structure is comprised of two substantially parallel, rodlike members joined together at one end by a mounting bracket but open between their rearward ends so that the structure may be positioned on the hull with one of said members above the wing and the other of said members below the wing. The members are adequately spaced from each other so that normal movement of the wing is not impeded in anyway. The forward edge of the parallel members is shaped so that they form an angle of attack greater than the angle of attack of the wing. As will be more clearly evident from the detailed description, this permits the rodlike members to be attached to the hull forward of the wing and to extend to a point over and below the wing, respectively, to thereby form an unbroken path between the hull and the leading edge of the wing. This allows any obstacle such as a buoy or anchor line which comes in contact with the seismic cable to ride upon the bird, along the protective structure until it contacts the leading edge of the wing, and then slip safely off the end of the wing. Due to the specific contruction of the protective member, there are no unprotected gaps or spaces between the wings and the hulls of the birds in which anchor lines or the like can become lodged.

Another part of the present protective means comprises a tapered, ring member which fits around the seismic cable just forward of a bird and is constructed to protect the bird from a buoy line or the like becoming lodged in the gap which is inherently present in birds having hulls made in two parts, as are most depth control devices of this type.

BRIEF DESCRIPTION OF THE DRAWINGS

The actual construction, operation, and the apparent advantages will be better understood by referring to the drawings in which like numerals identify like parts and in which:

FIG. 5 is a side view of the depth control device of FIG. 4;

FIG. 6 is a perspective, frontal view of the depth control device of FIG. 4;

FIG. 7 is a perspective view of the framelike protective structure of the present invention;

FIG. 8 is a side view of the tapered ring protective structure of the present invention; and FIG. 9 is a front view of the structure of FIG. 8.

DESCRIPTION OF THE PREFERRED EMBODIMENT

Figure 1:
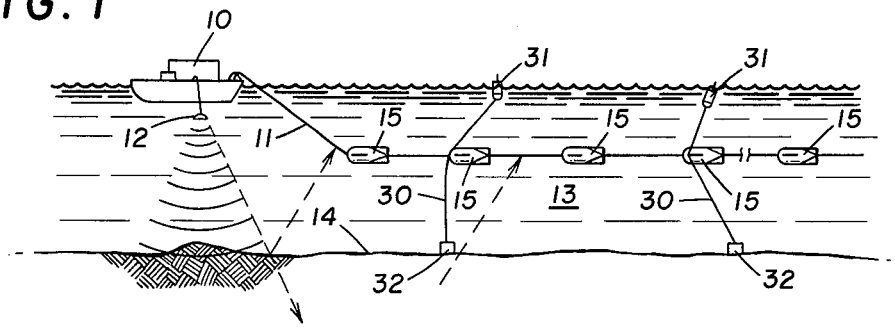
FIG. 1 is a perspective side view illustrating the hazards to depth control devices for seismic cables.

Referring more particularly to the drawings, FIG. 1 discloses a typical marine seismic operation wherein an electronically equipped vessel 10 is towing both a signal source 12 and a seismic detection cable 11 through a body of water 13. As is well known, source 12 is actuated to generate signals which pass downward through water 13 and reflect off various strata which underlie marine bottom 14. The reflected signals which constitute the data from which the seismic record is ultimately formed and which are illustrated as dotted lines in FIG. 1 are received by a plurality of geophones (not shown) or the like positioned at spaced points along cable 11. A plurality of depth control devices 15 are also spaced along cable 11 to control and maintain the depth at which cable 11 is towed.

Control devices 15 are of the type that are well known in the art and are commonly referred to as hydroplanes, paravanes, or more simply as "birds". For detailed examples of this general type depth control device, see U.S. Pat. Nos. 3,375,800; 3,434,446; 3,774,570; or 3,896,756. For the sake of brevity, only the general features of this type of depth controller will be described in connection with the present invention.

As shown in FIGS. 3, 4, 5, and 6, depth control device 15 is comprised of an elongated body or hull 21 which is preferably made of a lightweight, plastic material. Hull 21 is normally constructed in two sections, 22, 23 (FIGS. 5 and 6) which are hinged together to facilitate assembly onto seismic cable 11. Vertical and horizontal stabilizing fins 24 are fixed on the rear of hull 21 and a pair of moveable wings 25 are pivotably mounted on the forward portion of hull 21 by means of shafts 27 (see FIG. 3). Suitable means (not shown) are carried within hull 21 to move wings 25 between up and down positions (see dotted lines 25*a*, 25*b*, FIG. 5) in response to certain conditions to cause device 15 and hence cable 11 to rise or dive as it is towed through the water.

Figure 2:
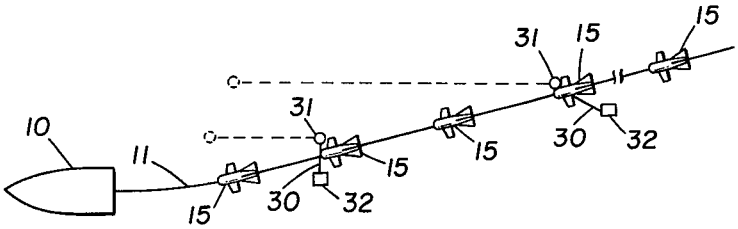
FIG. 2 is a perspective top view of FIG. 1.

In seismic operations as illustrated in FIGS. 1 and 2, certain obstacles are present in some areas which can damage or destroy depth control devices 15. One such common obstacle is the lines 30 which are used to secure marker buoys 31 to submerged objects 32, e.g., lobster or crab traps. As shown in FIG. 2, seismic cable 11, which may be as long as 3 miles in length, will normally drift due to currents, waves, etc., and will not follow in a straight line behind vessel 10. Even if vessel 10 maneuvers to avoid buoys 31, it is likely that at least one of the buoys will come into contact with cable 11 and will ride against cable 11 as vessel 10 continues to advance until line 30 engages a depth control device 15. When this occurs, line 30 may become ensnared on device 15 at either of two places, i.e., in the gap 35 (FIGS. 5 and 6) inherently present when upper portion 22 and lower portion 23 of hull 21 are joined together around cable 11 or in the gap 36 (FIGS. 4 and 6) which exists between moveable wings 25 and hull 21. Any buoy or anchor line 30 which becomes lodged in gap 35 or in gap 36 may exert a "sawing" effect on control device 15 as vessel 10 continues to tow cable 11 and may seriously damage same. Since these type depth control devices cost several thousands of dollars and substantial other expenses may occur due to delays for repairs, etc., protection against such hazards is important.

Figure 3:
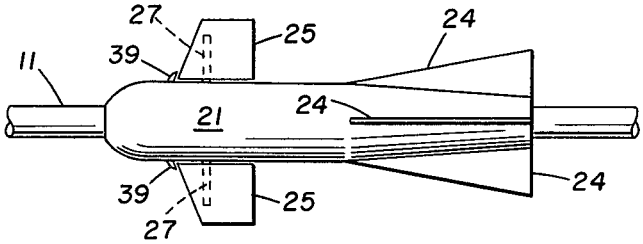
FIG. 3 is a top view of a depth control device with a protective means in accordance with the prior art.
Figure 4:
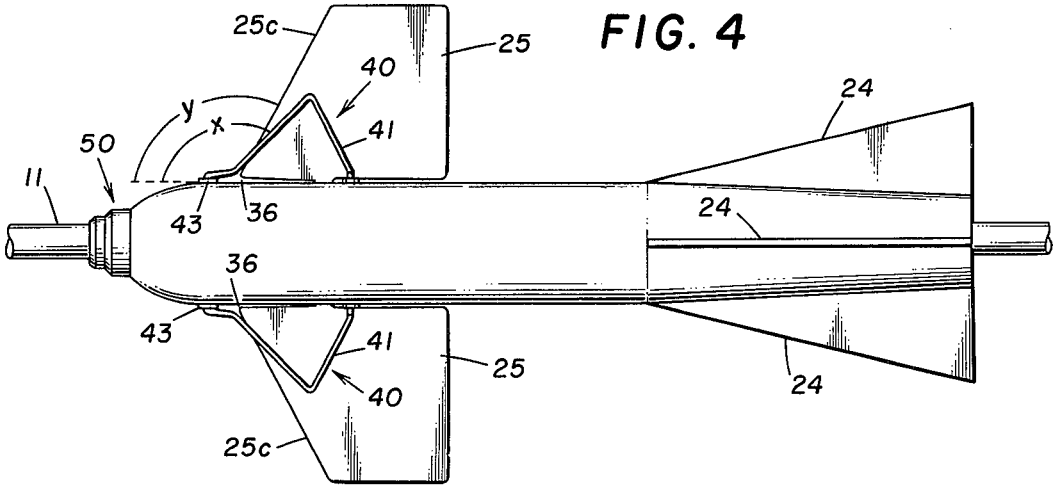
PRIOR ART FIG. 4
FIG. 4 is a top view of a depth control device incorporating the protective means of the present invention.

In prior art devices of this type (see FIG. 3 and U.S. Pat. No. 3,375,800), attempts have been made to protect the gap between the wing and the hull of a depth control device by using projections or guards 39 (FIG. 3), but in practice these have only met with partial success. It will be noted that with guards 39, there are still gaps between the rear of a guard and the leading edge of wing 25 into which a buoy line 30 or the like could become lodged. Guards 39 cannot be extended into contact with wing 25 to completely eliminate this gap since to do so would interfere with the necessary movement of wing 25.

In accordance with the present invention, protective means are provided to prevent a buoy line 30 or the like from becoming lodged in either gap 35 or gap 36 on control device 15. This protective means comprises framelike structure 40 and ring structure 50. Framelike structure 40 is comprised of two parallel rod elements 41, 42 joined together at their forward ends by mounting bracket 43 and brace member 44 as shown in FIGS. 5, 6, 7. The rearward ends of rods 41, 42 are not joined together but each has means, e.g., 45, 45*a*, thereon for attaching the rods to hull 21. Rods 41 and 42 are spaced from each other so that when structure 40 is in an operable position, neither rod will interfere with the normal movement of wings 25.

Rods 41, 42 are bent outwardly in a triangular shape from bracket 43 so that when framelike structure 40 is in position on hull 21, the angle $x$ (FIG. 4) formed between the forward portion of hull 21 and the leading edge rods 41, 42 is greater than the angle $y$ (FIG. 4) formed between hull 21 and the leading edge of wing 25. This permits rods 41, 42 to extend from hull 21 to a point over and below wing 25, respectively, to thereby provide an unbroken path along which any buoy or anchor line 30 which contacts control device 15 may be deflected safely from hull 21. Such a line 30 would slide along rods 41, 42 onto the leading edge 25*c* of wing 25 and safely off the end of said wing.

To protect device 15 from having a line 30 or the like becoming fouled in gap 35, ring structure 50 is positioned on cable 11 just forward of hull 21. Ring structure 50 is preferably formed from two symmetrical portions 51, 52 to facilitate assembly onto cable 11. Although ring 50 can be cast or the like, another technique of inexpensively constructing same may be used. Two cylinders 53, 54 of material, e.g., Bakelite, are selected so that the inside diameter of cylinder 54 is equal to the outside diameter of cable 11 and the outside diameter of cylinder 54 is substantially equal to the inside diameter of cylinder 53. The outside diameter of cylinder 53 is large enough to insure that gap 35 exposed at the leading end of hull 21 will be covered when ring structure 50 is in place on cable 11 (see FIG. 6). Both cylinders 53 and 54 are split and the halves of 54 are positioned within the halves of 53 and the two are slightly rotated with respect to each other to form an overlap 55 between the two. (See FIG. 9). The respective halves of 53, 54 are then glued together in this position to form portions 51, 52 of ring structure 50 which in turn are secured together on cable 11 by means of screws 56 or the like. The leading edges 57, 58 of cylinders 53, 54, respectively, are tapered so that a buoy line 30 or the like is cammed over ring structure 50 and onto hull 21 whenever such an obstacle is encountered during a seismic operation. Ring structure 50 thereby prevents the obstacle from becoming fouled in gap 35.

From the above description, it can be seen that the present invention provides a means for protecting commercially available depth control devices from certain, commonly encountered hazards and in so doing substantially reduces the expenses normally incurred from damages and delays caused by said hazards. Also equally important, the present invention prevents the control devices from damaging the lines securing marker buoys to submerged objects, e.g., lobster or crab traps, and thereby allows seismic operations to be compatibly carried out in areas where such objects are present.

What is claimed is:

1. A depth control device for a marine seismic cable or the like, said device comprising:

a hull adapted to be positioned onto said cable;

a pair of wing members pivotably mounted on said hull;

a pair of protective means, each of said protective means attached to said hull adjacent each of said wing members, respectively, to prevent an obstacle such as a buoy line or the like from becoming fouled in the gap normally existing between a wing member and said hull, each of said protective means comprising:

a pair of elements, one of said elements being attached to said hull at a point above said wing member and the other of said elements attached to said hull below said wing member, both of said elements extending from a point on said hull forward of said wing member to a point over and below, respectively, said wing member, said elements extending outward from said hull at an angle greater than the angle formed by the leading edge of a respective wing member with said hull whereby said elements form an unbroken path between said hull and said leading edge of said wing member which directs said obstacle away from said hull and off said wing member.

2. A depth control device as set forth in claim 1 wherein:

said elements are substantially parallel to each other and are properly spaced from each other so as not to impede the normal pivotal movement of said wing member.

3. A depth control device as set forth in claim 2 wherein:

each of said elements is comprised of a rod, means to join said rods to each other at their forward ends for maintaining said rods in a substantially parallel relationship to each other.

4. A depth control device as set forth in claim 1 wherein said hull is formed from a first portion and a second portion which are joined around said cable and including:

protection means adapted to be positioned on said cable just forward of said hull to cover the gap normally present between said first and second portions of said hull when in an assembled position.

5. A depth control device as set forth in claim 4 wherein said protection means comprises:

a ring structure having two symmetrical halves, the leading edge of said ring structure being tapered to direct an obstacle such as a buoy line or the like from said seismic cable onto said hull of said control device.

6. A protective means for preventing an obstacle such as a buoy line or the like from becoming lodged in a gap normally existing between a wing member and the hull of a depth control device of the type used to control the depth at which a marine seismic cable is towed, said protective means comprising:

two elements;

means for connecting said two elements to each other in a substantial parallel relationship, said elements being formed so that when in position on a hull of a depth control device one of said elements will be positioned on said hull at a point above said wing member and the other of said elements will be positioned on said hull below said wing member, both of said elements extending from a point of said hull forward of said wing member to a point over and below, respectively, said wing member, said elements extending outward from said hull at an angle greater than the angle formed by the leading edge of a respective wing member with said hull whereby said elements form an unbroken path between said hull and said leading edge of said wing member which directs said obstacle away from said hull and off said wing member; and means to mount said elements on said hull.

7. The protective means of claim 6 wherein said elements comprise:

rodlike elements that are bent into a triangular shape with the apex of the triangle of each element lying over or under, respectively, the surface of the wing member when said protective means is mounted on said hull.

8. The protective means of claim 7 wherein said elements are spaced from each other at a distance so that neither element will impede the normal movement of a wing member when said protective means is mounted on said hull.

* * * * *

Dedication 4,027,616.—*Robert O. Guenther*, Irving, *Donald F. Huffhines*, Richardson, *James W. Krall*, Irving, and *Charles D. Ray*, Dallas, Tex. PROTECTION MEANS FOR DEPTH CONTROL DEVICE. Patent dated June 7, 1977. Dedication filed July 14, 1977, by the assignee, *Mobil Oil Corporation.*

Hereby dedicates to the Public the entire term of said patent.

[*Official Gazette August 30, 1977.*]